US009549236B2

(12) United States Patent
Hamilton

(10) Patent No.: US 9,549,236 B2
(45) Date of Patent: Jan. 17, 2017

(54) CONDENSER MICROPHONE CAPSULE BACKPLATE

(71) Applicant: Freedman Electronics Pty Limited, Silverwater (AU)

(72) Inventor: Luke John Hamilton, Silverwater (AU)

(73) Assignee: FREEDMAN ELECTRONICS PTY LIMITED (AU)

( * ) Notice: Subject to any disclaimer, the term of this patent is extended or adjusted under 35 U.S.C. 154(b) by 0 days.

(21) Appl. No.: 14/231,184

(22) Filed: Mar. 31, 2014

(65) Prior Publication Data

US 2015/0271577 A1 Sep. 24, 2015

(30) Foreign Application Priority Data

Mar. 19, 2014 (AU) ..... 2014201670

(51) Int. Cl.
*H04R 25/00* (2006.01)
*H04R 1/02* (2006.01)
*H04R 19/04* (2006.01)

(52) U.S. Cl.
CPC ..... *H04R 1/02* (2013.01); *H04R 19/04* (2013.01); *H04R 2201/025* (2013.01)

(58) Field of Classification Search
USPC ..... 381/174
See application file for complete search history.

(56) References Cited

U.S. PATENT DOCUMENTS 3,845,838 A * 11/1974 Malmrose ..... G10K 11/22 181/129
4,219,789 A * 8/1980 Frangos ..... H01R 31/00 333/32
5,881,156 A * 3/1999 Treni ..... H04R 1/406 379/202.01
2008/0232615 A1* 9/2008 Song ..... H04R 19/005 381/174
2014/0010374 A1* 1/2014 Kasai et al. ..... 381/26

* cited by examiner

*Primary Examiner* — Amir Etesam
(74) *Attorney, Agent, or Firm* — Galgano IP Law PLLC; Thomas M. Galgano; Jessica G. McDonald

(57) ABSTRACT

An assembly for a condenser microphone capsule, the assembly comprising: a plate having opposing planar surfaces and one or more tabs extending laterally from a peripheral region, at least one tab being adapted to receive an electrical connector; and a mount affixed around at least a portion of the peripheral region.

7 Claims, 5 Drawing Sheets

| B: Results | | | Limits | |
|---|---|---|---|---|
| Microphone Sensitivity | 42.49 mV/Pa | Passed | Max/Min | 1000.0/1.0 |
| Mic Sen dB | -27.43 dB | Passed | Max/Min | -1.0/-60.0 |

| B: Results | | | Limits | |
|---|---|---|---|---|
| Microphone Sensitivity | 36.36 mV/Pa | Passed | Max/Min | 1000.0/1.0 |
| Mic Sen dB | -28.79 dB | Passed | Max/Min | -1.0/-60.0 |

CONDENSER MICROPHONE CAPSULE BACKPLATE

TECHNICAL FIELD

The present invention relates generally to microphones and in particular, to a "backplate" assembly for a condenser microphone transducer.

BACKGROUND TO THE INVENTION

A microphone has at least one transducer assembly, known as a "capsule", which detects sound waves and converts the detected sound waves into an electrical signal. A condenser microphone has a capsule typically comprising a metal disc, known as a "backplate", fixed in a spaced apart position and insulated from a metal (or metal plated) diaphragm. The backplate and diaphragm are connected to electrical connectors and act as opposing plates of a capacitor, having a capacitance directly proportional to the size and spacing of the diaphragm and backplate. The components and spacing dimensions in the condenser microphone capsule are typically very small, with the diaphragm being approximately 6 um thick and spaced apart from the backplate by approximately 40 um.

When the diaphragm is vibrated due to sound waves, it moves towards and away from the backplate, varying the spacing between the diaphragm and the backplate and causing a change in capacitance. When an appropriate electrical circuit is connected to the backplate and diaphragm, the change in capacitance is detected and an electrical signal is generated.

The condenser microphone backplate includes an assembly comprising a planar metal disc and a mount, the mount adapted to connect the disc to a capsule assembly and insulate the disc from the diaphragm. For a considerable length of time, backplate assemblies have been produced by initially fabricating the metal disc using a milling process; over-moulding a plastic mount around the perimeter of the disc; a second stage of milling to finish the planar surfaces and fabricate an array of first apertures in the disc and mount in a first direction, perpendicular to the planar surfaces of the disc; a third stage of milling to fabricate one or more second apertures in the disc and mount in a second direction, parallel to the planar surfaces; and tapping the second apertures to allow electrical connectors to threadably engage with the disc. The backplate assembly is then connected to the capsule assembly by a plurality of fasteners connected through some of the first apertures.

Whilst this process of producing backplate assemblies has been practiced successfully for some time, it has a number of drawbacks. For example, the process has many different stages, each stage adding complexity, margin for error and cost. This is particularly the case when further machinery is required to perform each additional step of the process. Also, the stage of milling and tapping the second apertures can prove problematic as this can distort the plastic mount, which consequently can affect the spacing between the backplate and the diaphragm and degrade the quality of electrical signal generated by the capsule.

Accordingly, it would be useful to provide an alternative backplate assembly for a condenser microphone capsule which is produced by a simpler, quicker, more consistent and/or more cost effective process than the prior art approaches.

SUMMARY OF THE INVENTION

According to an aspect of the invention there is provided an assembly for a condenser microphone capsule, the assembly comprising:

a plate having opposing planar surfaces and one or more tabs extending laterally from a peripheral region, at least one tab being adapted to receive an electrical connector; and a mount affixed around at least a portion of the peripheral region.

Other aspects are also disclosed.

BRIEF DESCRIPTION OF THE DRAWINGS

Preferred embodiments of the invention will now be described, by way of example only, with reference to the accompanying drawings in which.

DETAILED DESCRIPTION OF PREFERRED EMBODIMENTS

Figure 1:
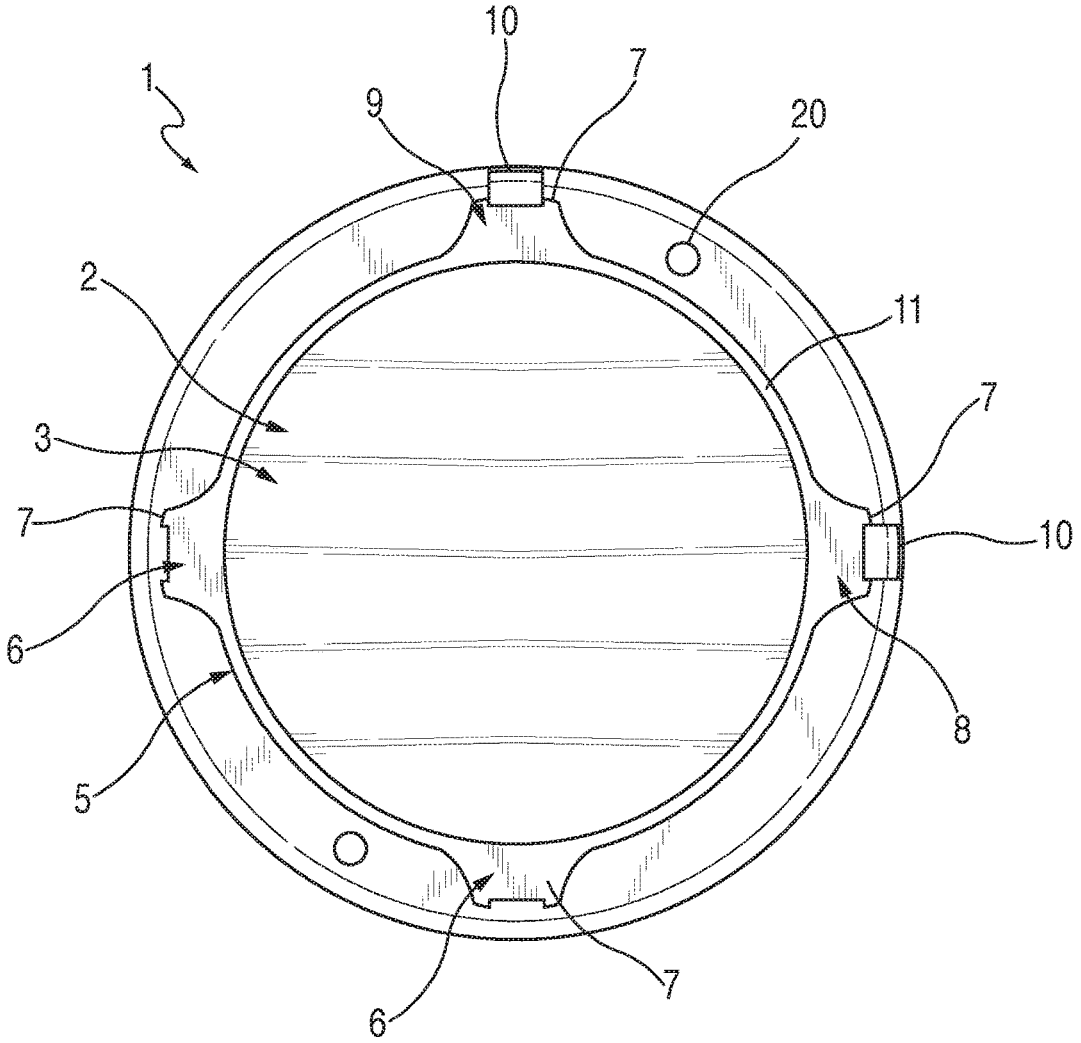
FIG. 1 is a top view of a backplate assembly, partially manufactured.

In FIG. 1, a backplate assembly 1 is shown partially manufactured. The assembly 1 comprises a plate 2 having two opposing planar surfaces 3, 4 joined by side-walls 5. In the example shown in FIG. 1 the plate 2 is configured as a circular disc however it will be appreciated that the plate can be configured in other shapes. The plate 2 has a plurality of tabs 6 extending laterally from the plate 2, each tab terminating at an end face 7 offset from the side-walls 5. The tabs 6 are spaced at regular intervals in an annular region around the periphery of the plate 2 and have a thickness less than the thickness of the plate 2, being the distance between the planar surfaces 3, 4. It is preferable that the plate 2 has four tabs 6 however the plate 2 may be adapted to have more or less tabs 6, depending on design requirements, including a single tab which extends laterally from the plate 2 around the annular region. At least one tab 6 is adapted to receive an electrical connector (not shown). In the example shown, two of the tabs 8, 9 have apertures 10 extending radially inwards from respective end faces 7. Each aperture 10 is tapped, thereby allowing the electrical connector to be threadably engaged with the plate 2. The plate 2 also has a lip 11 that protrudes laterally from the plate 2 and extends around at least part of the annular region.

The assembly 1 also includes a mount 20 affixed to the plate 2. The mount 20 at least partially encloses the annular, peripheral region of the plate 2, connected to the lip 11 and side-walls 5. Preferably, the mount 20 also encloses at least some of the tabs 6. The mount 20 is formed from an electrically insulating material, such as a plastic, thereby insulating the plate 2 from other components the mount 20 is connected to.

Figure 2:
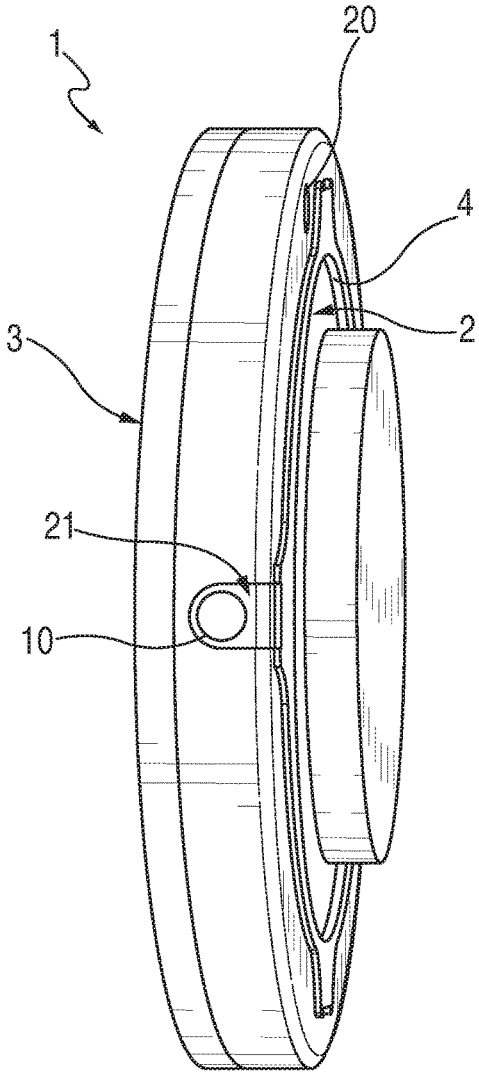
FIG. 2 is a side view of the backplate assembly shown in FIG. 1.

FIG. 2 shows a side of the assembly 1, illustrating one of the tabs 8 adapted to connect to an electrical connector, having a tapped aperture 10. The mount 20 has a recess 21 arranged over the aperture 10, providing access for an electrical connector to pass through the mount 20 and engage with the plate 2.

The assembly 1 has been manufactured by initially milling a blank of material (in this case brass plate) with a milling spindle (not shown) to fabricate the plate 2 having tabs 6 and a lip 11. During this stage of fabrication, an end wall 7 of at least one tab 8, 9 is milled to form the aperture 10. Also, the aperture 10 is tapped by the milling spindle operating a tapping tool, or by a separate operation.

The plate 2 is then inserted into a cavity of a mould tool (not shown) configured to receive the plate 2 in a specific orientation by at least some of the tabs 6 engaging with features within the cavity. Molten plastic is injected into the cavity to mould the mount 20 in contact with the plate 2, securing the mount 20 to the lip 11 and side-walls 5. The mould tool has portions that protrude within the cavity and cover each aperture 10, thereby moulding the recess 21 in the mount 20 over each aperture 10.

Figure 3:
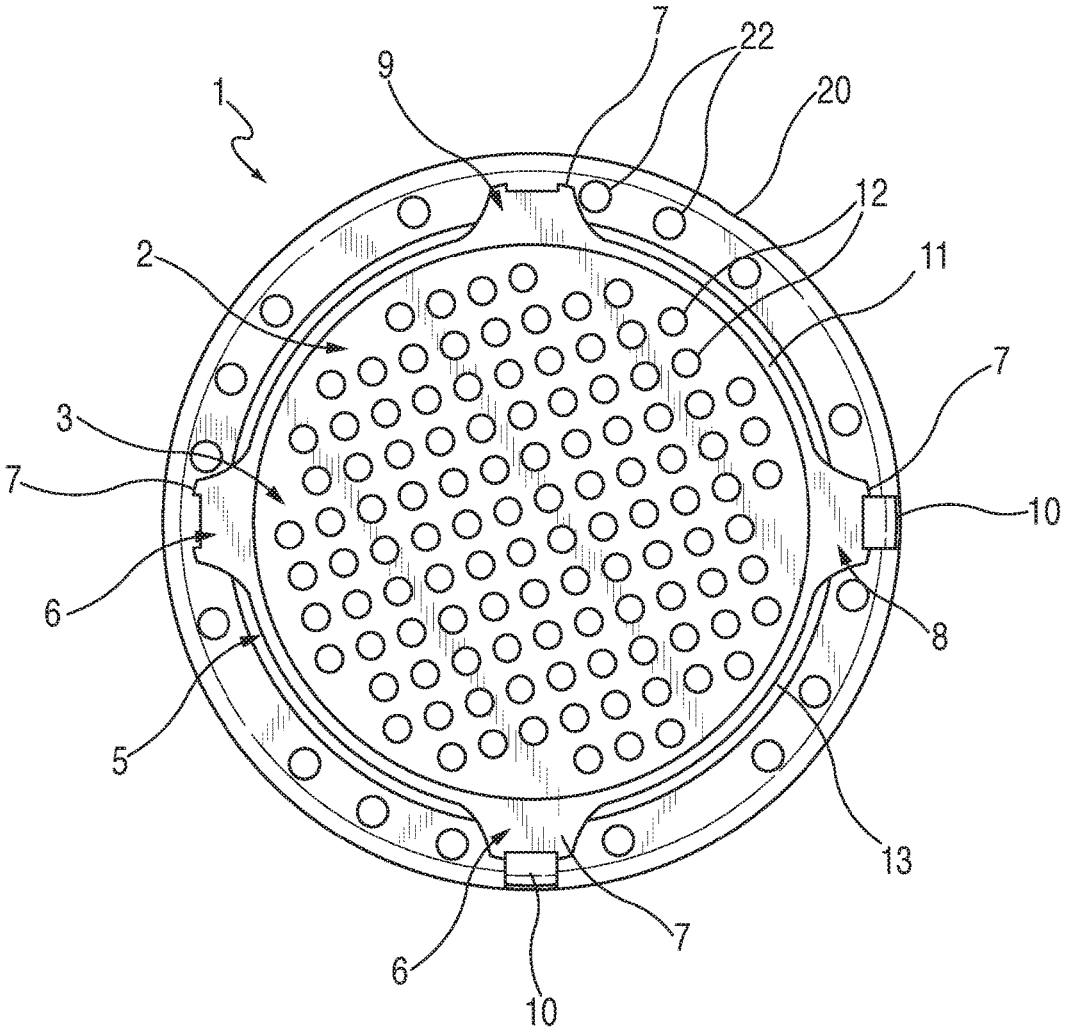
FIG. 3 is a top view of the backplate assembly, completely manufactured.

FIG. 3 shows the assembly 1 after being manufactured. The plate 2 has a plurality of sound apertures 12 extending at least partway through the plate 2 from the planar surface 3. The mount 20 has an array of fixing apertures 22 extending through the mount 20, adapted to allow respective fasteners to pass through and secure the assembly 1 to a capsule assembly (not shown). The plate 2 also has a groove 13 arranged in an alternative annular region, providing an air gap when the assembly 1 is connected to the capsule assembly.

Figure 4:
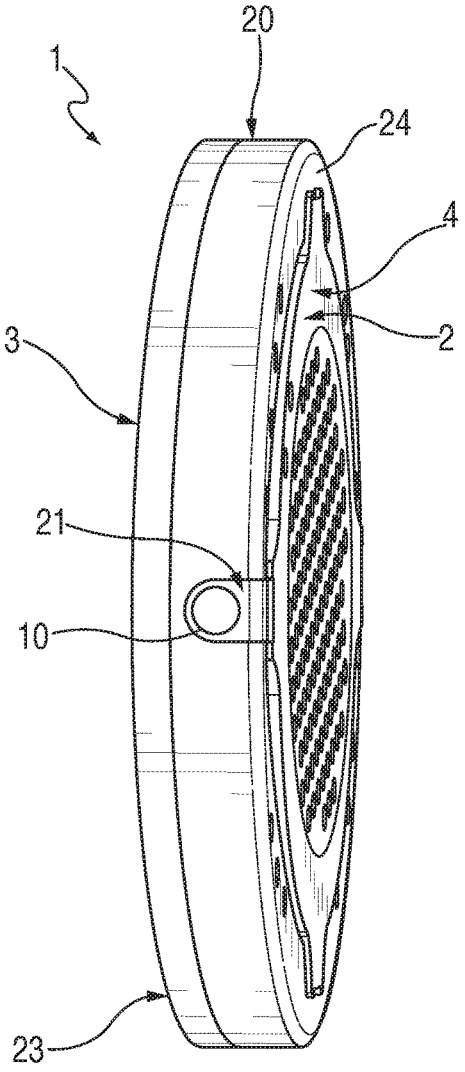
FIG. 4 is a side view of the backplate assembly shown in FIG. 3.

FIG. 4 shows a side view of the assembly 1. The plate 2 has flush planar surfaces 3, 4 with top and bottom faces 23, 24 of the mount 20.

The assembly 1 is finished from the partially manufactured stage, shown in FIGS. 1 and 2, to the complete stage, shown in FIGS. 3 and 4 by a single milling operation, which fabricates the sound apertures 12, groove 13 and fixing apertures 22, and finishes the top and bottom faces 3, 4, 23, 24.

Figure 5:
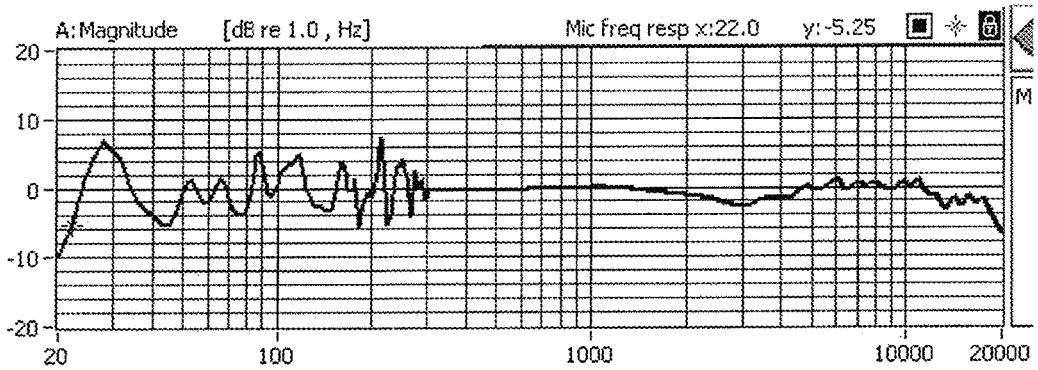
FIG. 5 is a graph of attenuation vs. rhythmic scale frequency for a prior art backplate assembly.

FIG. 5 is a graph of attenuation vs. rhythmic scale frequency for a capsule assembly (not shown) which includes an alternative backplate assembly (not shown), having a similar construction to the backplate assembly 1 but lacking tabs 6, and having apertures 10 drilled and tapped as an additional manufacture stage, after fabricating and moulding the plate 2 and mount 20.

Figure 6:
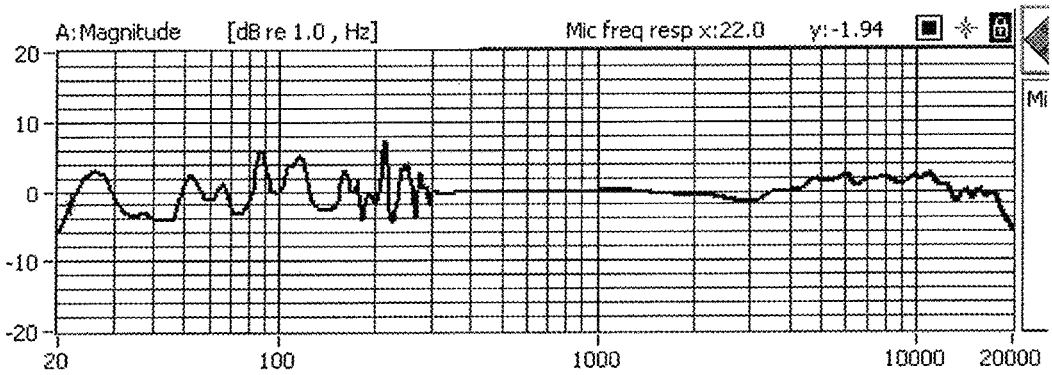
FIG. 6 is a graph of attenuation vs. rhythmic scale frequency for the backplate assembly shown in FIGS. 3 and 4.

FIG. 6 is also a graph of attenuation vs. rhythmic scale frequency for the capsule assembly used to generate the graph in Figure A which includes the backplate assembly 1.

FIG. 5 shows attenuation resulting from the alternative backplate assembly varying significantly at low frequency vibrations, particularly vibrations less than 40 Hz. This is known as low frequency losses and is generally undesirable, as this can degrade the quality of audio recorded using the capsule assembly. Conversely, FIG. 6 shows the resulting from apparatus 1 to vary less, particularly in this low frequency range.

This is partly due to the additional manufacture stage employed in the production of the alternative backplate assembly, which often distorts the mount 20 and affects the orientation of the plate 2 when connected to the capsule assembly. As the separation distance between the backplate and diaphragm is typically very small (approximately 40 um), any variation of this distance can affect the change in capacitance detected by the capsule assembly and hence affect the signal generated.

As this additional manufacture stage is not necessary when manufacturing the assembly 1, this reduces the risk of deforming the mount 20, resulting in a more consistent separation between the backplate 1 and the diaphragm, which reduces frequency losses.

It will be apparent that obvious variations or modifications may be made which are in accordance with the spirit of the invention and which are intended to be part of the invention.

The invention claimed is:

1. An assembly for a condenser microphone capsule, the assembly comprising:

a plate having opposing planar surfaces and defining a central axis and peripheral region extending thereabout, the plate comprising one or more tabs projecting laterally away from the peripheral region and away from the central axis, wherein at least one of the one or more tabs comprises as aperture extending radially therein relative to the central axis, the aperture adapted to engage an electrical connector and provide an electrical connection between the electrical connector and the plate; and a mount for mounting the assembly to the condenser microphone capsule, the mount abutting and wrapping around the peripheral region and the one or more tabs, thereby enclosing a periphery of the plate and defining an annular surface surrounding the plate and arranged parallel to the planar surfaces, the mount formed from an electrical insulator thereby insulating the plate from the condenser microphone capsule.

2. The assembly according to claim 1, wherein the mount has a recess extending therein proximal to the aperture and dimensioned to allow the electrical connector to engage the aperture.

3. The assembly according to claim 2, wherein the plate comprises a plurality of the tabs and the mount abuts and encloses the peripheral region and each of the plurality of tabs.

4. The assembly according to claim 3, wherein the plurality of tabs are equidistantly spaced around the peripheral region.

5. The assembly according to claim 4, wherein the plate has four tabs.

6. The assembly according to claim 1, wherein the mount defines a sidewall extending around a periphery thereof, and each of the one or more tabs has an end face arranged substantially parallel to and spaced apart from the sidewall, within the periphery of the mount, and wherein the recess extends through the sidewall and at least up to one of the end faces.

7. The assembly according to claim 6, wherein the aperture is arranged proximal to the recess and extends into the respective end face, thereby allowing the electrical connector to be engaged therein.

* * * * *